US005845648A

United States Patent [19]

Martin

[11] Patent Number: 5,845,648

[45] Date of Patent: Dec. 8, 1998

[54] MULTI-COMPARTMENT EXPANDABLE FILTER FOR A SMOKING PRODUCT

[76] Inventor: John E. Martin, 1006 Colonial Ave., Colonial Heights, Va. 23834

[21] Appl. No.: 867,867

[22] Filed: Jun. 3, 1997

[51] Int. Cl.[6] ..... A24B 15/00

[52] U.S. Cl. ..... 131/332; 131/331; 131/336; 131/339; 131/361

[58] Field of Search ..... 131/332, 331, 131/336, 339, 361

[56] References Cited

U.S. PATENT DOCUMENTS

| | | | |
|---|---|---|---|
| 3,658,069 | 4/1972 | Wise et al. | 131/265 |
| 3,662,765 | 5/1972 | Clark | 131/332 |
| 3,882,877 | 5/1975 | Brackmann et al. | 131/332 |
| 4,696,314 | 9/1987 | Kallianos et al. | 131/336 |
| 4,736,755 | 4/1988 | Oldham et al. | 131/332 |
| 5,050,621 | 9/1991 | Creighton et al. | 131/332 |

*Primary Examiner*—Kimberly L. Asher
*Assistant Examiner*—Charles W. Anderson
*Attorney, Agent, or Firm*—Patent & Trademark Services; Joseph H. McGlynn

[57] ABSTRACT

A filter which will be attached to the end of a smoking product such as a cigarette. It would have a normal filter connected to the tube of tobacco, with a dual chamber which holds fine tobacco dust particles in one chamber. The other chamber would contain a plurality of loose fibers and would be connected to another normal cigarette filter.

5 Claims, 1 Drawing Sheet

MULTI-COMPARTMENT EXPANDABLE FILTER FOR A SMOKING PRODUCT

BACKGROUND OF THE INVENTION

This invention relates, in general, to filters, and, in particular, to a filter for smoking products.

DESCRIPTION OF THE PRIOR ART

In the prior art various types of filters have been proposed. For example, U.S. Pat. No. 3,662,765 discloses a porous filter comprising an organopolysiloxane disposed in the conduit through which smoke is forced to pass for removing undesirable materials such as particulate matter from smoke.

U.S. Pat. No. 3,882,877 discloses a tobacco smoke filter which consists of non-crimped fibers of thermoplastic polymeric non-absorbent materials having a diameter less than 5 microns.

U.S. Pat. No. 4,736,755 discloses a method of loading nicotine into porous polymeric items consisting essentially of a polyolefin.

U.S. Pat. No. 5,050,621 discloses a smoking article comprising a heating unit, aerosal generation selection in flow communication at a first end with the heating unit, a mixing space and a velocity accelerating orifice in communication with the mixing space.

SUMMARY OF THE INVENTION

The present invention comprises a filter which will be attached to the end of a smoking product such as a cigarette. It would have a normal filter connected to the tube of tobacco, with a dual chamber which holds fine tobacco dust particles in one chamber. The other chamber would contain a plurality of loose fibers and would be connected to another normal cigarette filter.

It is an object of the present invention to provide a new and improved cigarette filter.

These and other objects and advantages of the present invention will be fully apparent from the following description, when taken in connection with the annexed drawings.

DESCRIPTION OF THE PREFERRED EMBODIMENT

Figure 1:
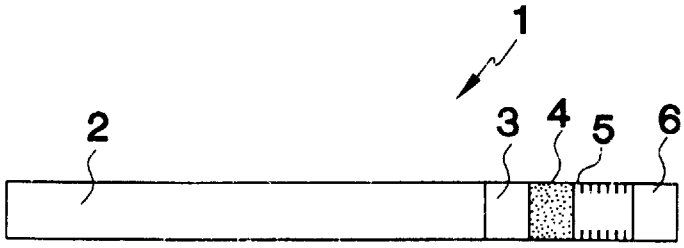
FIG. 1 is a side view of a cigarette incorporating the present invention.

Referring now to the drawings in greater detail, FIG. 1 shows a smoking product comprising a cigarette 1 which has a tube 2 which contains tobacco. Attached to the end of the tube 2 is a normal cigarette filter Tow 3. Tow is the normal material from which cigarette filters are made. It contains greater than 99% cellulose acetate polymer and is sprayed with a plasticizer which hardens and holds the Tow together in a round shape. It is made by companies such as Hoechst Celanese.

Attached to the Tow 3 is another filter chamber 4 which contains small tobacco dust particles 7 which can be placed in the chamber 4 using conventional combiner technology.

A combiner is used to put sections of loose charcoal in Lark cigarettes. Since this is conventional technology no further explanation or description will be given.

Figure 2:
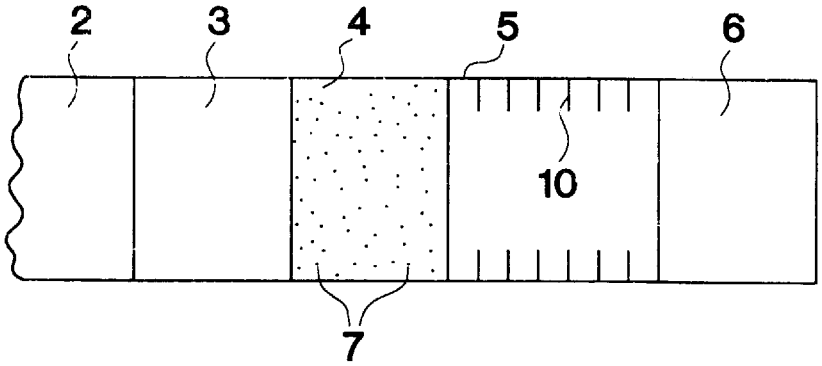
FIG. 2 is a partial side view of the filter of the present invention.
Figure 3:
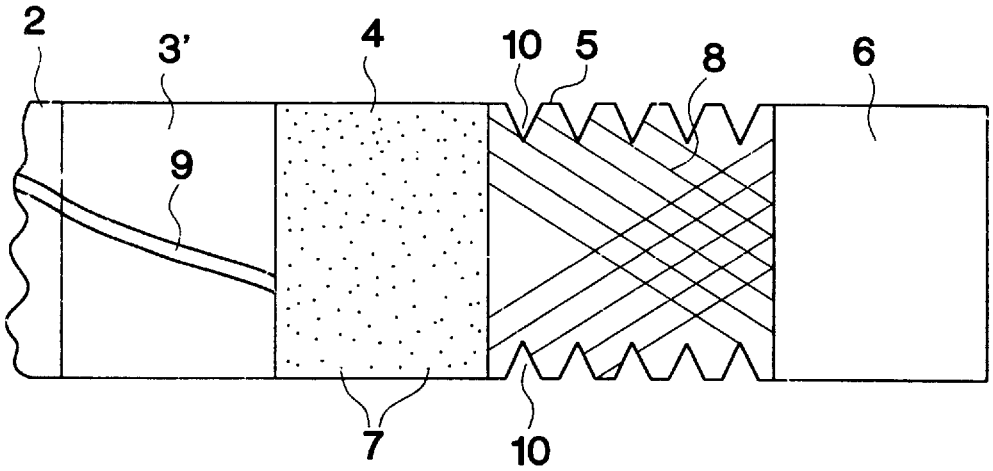
FIG. 3 is a side view of another embodiment of the present invention.

Attached to the filter chamber 4 is a third filter chamber 5 which will contain Tow fibers which have not been sprayed with a plasticizer. The fibers will be glued or otherwise attached to the inner sides of the chamber 5 by any conventional method. The chamber 5 as shown in FIG. 2 is collapsed, as shown by the closed expansion joints 10. When the expansion joints 10 are expanded, as shown in FIG. 3, the Tow fibers 8 will be pulled to form a web of fibers filling the chamber 6. These fibers 8 will act in a similar fashion as hairs in the human nose, and trap particles that have passed from or through the filters 3, 4. Attached to the chamber 5 is a second normal Tow filter 6 which is the same as the filter 3.

It should be noted that the fibers 8 are preferably placed into the chamber 5 in an unexpanded condition and then expanded when the expansion joints 10 are pulled apart. However, they could also be placed into a chamber 5 in an expanded condition. In that case the chamber 5 will not have to be made with the expansion joints 10 as there is no need to expand the fibers 8.

In addition, the small tobacco dust particles 7 in chamber or filter 4 could be flavored with products such as, but not limited to tobacco flavor or menthol. The small tobacco dust particles 7 will act as an absorber to absorb small amounts of tar and nicotine.

FIG. 3 also illustrates an optional air passage 9 that can be added to the filter 3' to assist in the draw of smoke through the cigarette. Also, the air passage 9 could be a series of apertures instead of the slot shown in FIG. 3.

Although the Swirl Charged Particle Filter and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A multi-compartment filter for a smoking product comprising:

a first filter compartment attached to an end of a smoking product, a second filter compartment attached to said first compartment, said second filter compartment containing dust particles, a third filter compartment attached to said second filter compartment, said third filter compartment containing fibers which are attached to adjacent sides of said third filter compartment, a fourth filter compartment attached to said third filter compartment.

2. The multi-compartment filter as claimed in claim 1, wherein said dust particles are composed of tobacco dust.

3. The multi-compartment filter as claimed in claim 1, wherein said third filter compartment is expandable.

4. The multi-compartment filter as claimed in claim 1, wherein said third filter compartment contains expansion joints in an outside surface whereby said third filter compartment is expandable.

5. The multi-compartment filter as claimed in claim 1, wherein said fibers in said third filter compartment are attached to adjacent sides of said third filter compartment by gluing.

* * * * *